US006280298B1

(12) United States Patent
Gonzales

(10) Patent No.: US 6,280,298 B1
(45) Date of Patent: Aug. 28, 2001

(54) TEST PROBE CLEANING

(75) Inventor: Dean E. Gonzales, Santa Clara, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/449,430

(22) Filed: Nov. 24, 1999

(51) Int. Cl.[7] ..... B24B 1/00

(52) U.S. Cl. ..... 451/56; 451/444

(58) Field of Search ..... 451/28, 41, 285, 451/287, 56, 57, 444; 134/2, 3, 6, 8, 22.1, 22.13, 22.17, 26, 28, 41; 510/254, 245, 367, 372

(56) References Cited

U.S. PATENT DOCUMENTS 4,314,855 * 2/1982 Chang et al. ..... 134/3
5,728,229 * 3/1998 Despres ..... 134/32

* cited by examiner

*Primary Examiner*—Derris H. Banks
(74) *Attorney, Agent, or Firm*—Robert G. Winkle

(57) ABSTRACT

The present invention relates to apparatus and methods for cleaning debris from a test probe. Debris is cleaned from the test probe by oxidizing the test probe debris in an oxidizing agent and dissolving said oxidized debris in a cleaning agent. Preferably, a membrane, such as a liquid polymer, is disposed over the oxidizing agent and/or the cleaning agent to prevents any off-gassing of either agent, prevent reaction of either agent with ambient atmosphere or each other, and/or prevent either agent being spilled and/or having personnel exposed to either agent.

30 Claims, 13 Drawing Sheets

TEST PROBE CLEANING

BACKGROUND OF THE INVENTION

1. Field of the Invention

The present invention relates to apparatus and methods for the cleaning of test probes. In particular, the present invention relates to oxidizing debris on a test probe with an oxidizing agent and removing the oxidized debris with a cleaning agent.

2. State of the Art

In a typical semiconductor device manufacturing process, a plurality of integrated circuitry (IC) components are formed on a wafer, such as a silicon wafer. Once the IC components are formed, the wafer is diced into individual chips. These chips are then packaged for use, as known in the art.

The formation of the IC components requires numerous individual processing operations, primarily material layering and patterning, performed in a specific sequence. Each of these operations must be precisely controlled and monitored so that the IC components operate with the required electrical characteristics. However, even though the operations are precisely controlled and monitored, IC component failures still occur. Thus, it is important to detect the defective IC components as early as possible to prevent the unnecessary expense of continuing the fabrication of the defective IC components.

The IC components are generally tested after they are fabricated on the wafer and just prior to the dicing the wafer into individual chips. A typical method of testing the electrical characteristics of the IC components requires physical contact with the wafer surface. As shown in FIG. 7, the physical contact generally comprises contacting a plurality of bond pads 202 on an IC wafer 204 (defined as a wafer having IC components and material layers thereon) with a plurality of test probes 206 housed in a probe housing 208. The test probes 206 are usually fabricated from metal material and reside in vias 212 that extend into the probe housing 208. The test probes may be biased by a spring mechanism 214. The test probes 206 are each in electrical contact with traces 216 (shown as dashed lines) within the probe housing 208 which directs electrical test signals to the IC wafer 204. The test probes 206 extend out of the probe housing vias 212 to contact the IC wafer bond pads 202. The IC wafer bond pads 202 are in electrical contact with IC components (not shown) through a plurality of traces 218 (shown as dashed lines) within the IC wafer 204.

As shown in FIG. 8, each test probe 206 has a tapered tip 222 that presses into the IC wafer bond pad 202. Pressing the test probe tapered tip 222 into the IC wafer bond pad 202 helps ensure that the test probe 206 makes sufficient electrical contact with the IC wafer bond pad 202 for testing purposes. Thus, the IC component within the IC wafer 204 can be tested for specific electrical characteristics by sending and/or receiving signals through the test probe 206. The IC components that fail the test procedure are "mapped" such that when the IC wafer 204 is diced the chips containing the failing IC components can be culled.

The IC wafer bond pad 202 is general made from a conductive material, including copper, aluminum, solder (lead/tin alloy), or the like. One problem which occurs in such a testing procedure is the buildup of debris 224 on the test probe tapered tip 222, as shown in FIG. 9. The debris 224 primarily comprises the conductive material of the IC wafer bond pad 202 that is "picked" off the IC wafer bond pad 202 by the test probe tapered tip 222, and/or otherwise coats the test probe tapered tip 222. The debris 224 can prevent sufficient electrical connectivity between the test probe 206 and the IC wafer bond pad 202. If sufficient electrical connectivity is not achieved, the test procedure will result in a false fail indication, which may result in a potential culling of a "good" IC chip. Thus, the debris 224 must be removed from the test probe tapered tips 222.

One method of cleaning test probes 206 is to manually brush or otherwise abrade the test probe tapered tips 222. However, an abrasive method can spread the debris 224 and can wear the critical tapered tips 222 of the test probes 206.

A non-abrasive method of cleaning test probe tapered tips 222 is to spray a chemical solvent on the test probes 206 to dissolve the debris 224. However, such cleaning processes can force the debris 224 and moisture into the probe housing 208. The debris 224 and moisture can cause ionization, which can result in leakage and shorting failures, thus yielding erroneous test results. Furthermore, the debris 224 can become trapped in the probe housing vias 212 that can cause the test probe 206 to stick in the probe housing via 212 and not contact the IC wafer bond pad 202. Thus, the stuck test probe would generate a false fail indication.

Therefore, it would be advantageous to develop apparatus and techniques to clean test probes while eliminating the inherent problems with present techniques of test probe cleaning.

SUMMARY OF THE INVENTION

The present invention relates to apparatus and methods for cleaning debris from a test probe. Debris is cleaned from the test probe by oxidizing the test probe debris in an oxidizing agent and dissolving said oxidized debris in a cleaning agent.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE ILLUSTRATED EMBODIMENT

Although FIGS. 1, 2, 3, 4*a–b*, 5, and 6*a–c* illustrate various views of the present invention, these figures are not meant to portray test probe equipment in precise detail. Rather, these figures illustrate the present invention in a manner to more clearly convey the concepts thereof. Additionally, elements common between the figures retain the same numeric designation.

Figure 1:
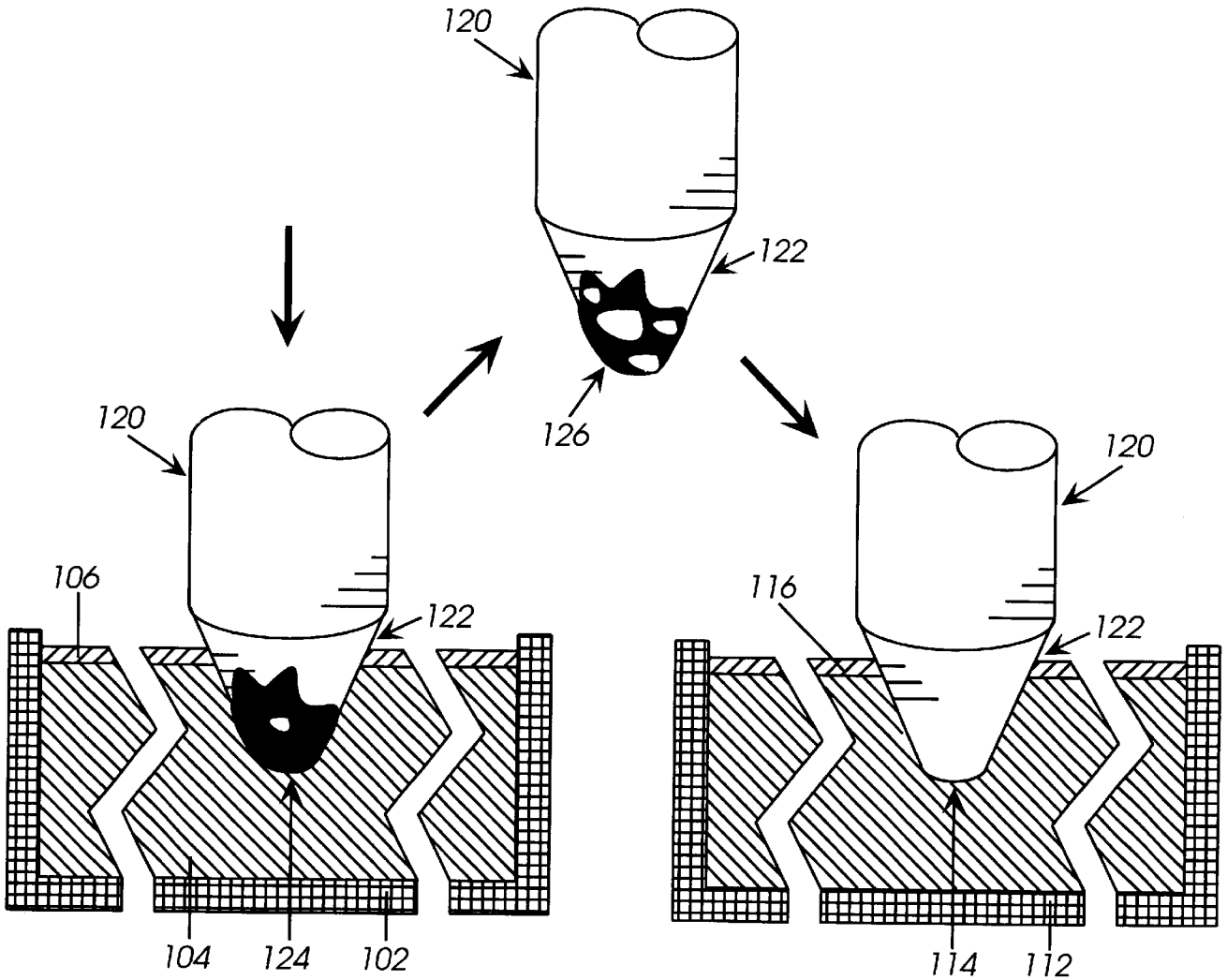
FIG. 1 is a side cross-sectional view of a first embodiment of a test probe cleaning apparatus, according to the present invention.

FIGS. 1 illustrates an embodiment of a test probe cleaning apparatus 100 according to the present invention. The test probe cleaning apparatus 100 comprises a first reservoir 102 containing an oxidizing agent 104, such a hydrogen peroxide preferably at a concentration of between about 30 and 40% by volume. The oxidizing agent 104 is selected for its ability to oxide the debris of concern on a test probe tip. A first membrane 106, such as polymer, preferably a copolymer consisting of polyester or benzocyclobutene material, disposed on the oxidizing agent 104. The first membrane 106 is, preferably, a liquid that is substantially immiscible in and has a lower density than the oxidizing agent 104, such that it "floats" on the oxidizing agent 104. Preferably, the first membrane is between about 20 and 30 $\mu$m thick. The first membrane 106 prevents any off-gassing of the oxidizing agent 104, prevents reaction of the oxidizing agent 104 with ambient atmosphere, and/or helps prevent spills and expose to personnel. However, it is understood that if these issues are not a concern then the first membrane 106 is not necessary.

As also shown in FIG. 1, the test probe cleaning apparatus 100 further includes a second reservoir 112 containing a cleaning agent 114. The cleaning agent 114 is preferably an acid-containing solution, most preferably a glacial acid solution at a concentration of between about 50 and 100% by volume. The cleaning agent 114 is selected based on it ability to dissolve oxidized debris of concern on a test probe tip. The cleaning agent 114 has a second membrane 116, such as a polymer, preferably a polyimide or a cross-linkeable copolyester material, disposed thereon. Similar to the first membrane 106, the second membrane 116 is, preferably, a liquid that is substantially immiscible in and has a lower density than the cleaning agent 114, such that it "floats" on the cleaning agent 114. Preferably, the second membrane is between about 80 and 100 $\mu$m thick. As with the first membrane 106, the second membrane 116 prevents any off-gassing of the cleaning agent 114, prevents reaction of the cleaning agent 114 with ambient atmosphere, and/or helps prevent spills and expose to personnel. However, it is understood that if these issues are not a concern then the first membrane 116 is not necessary.

Referring to FIG. 1, a test probe 120 may be cleaned by inserting a tip 122 of the test probe 120 through the first membrane 106 and into the oxidizing agent 104. Debris 124 on the test probe tip 122 becomes oxidized. The test probe 120 is then removed from the oxidizing agent 104. Upon removal of the test probe 120, the first membrane 106 seals itself, thus retaining a seal between the oxidizing agent 104 and the ambient environment.

The test probe 120, now having oxidized debris 126 thereon, is inserted through the second membrane 116 and into the cleaning agent 114 wherein the oxidized debris 126 is dissolved. The second membrane 116 seals itself once the test probe 120 is extracted, thus trapping any hazardous waste generated as a by-product of the dissolution of the oxidized debris 126.

Figure 8:
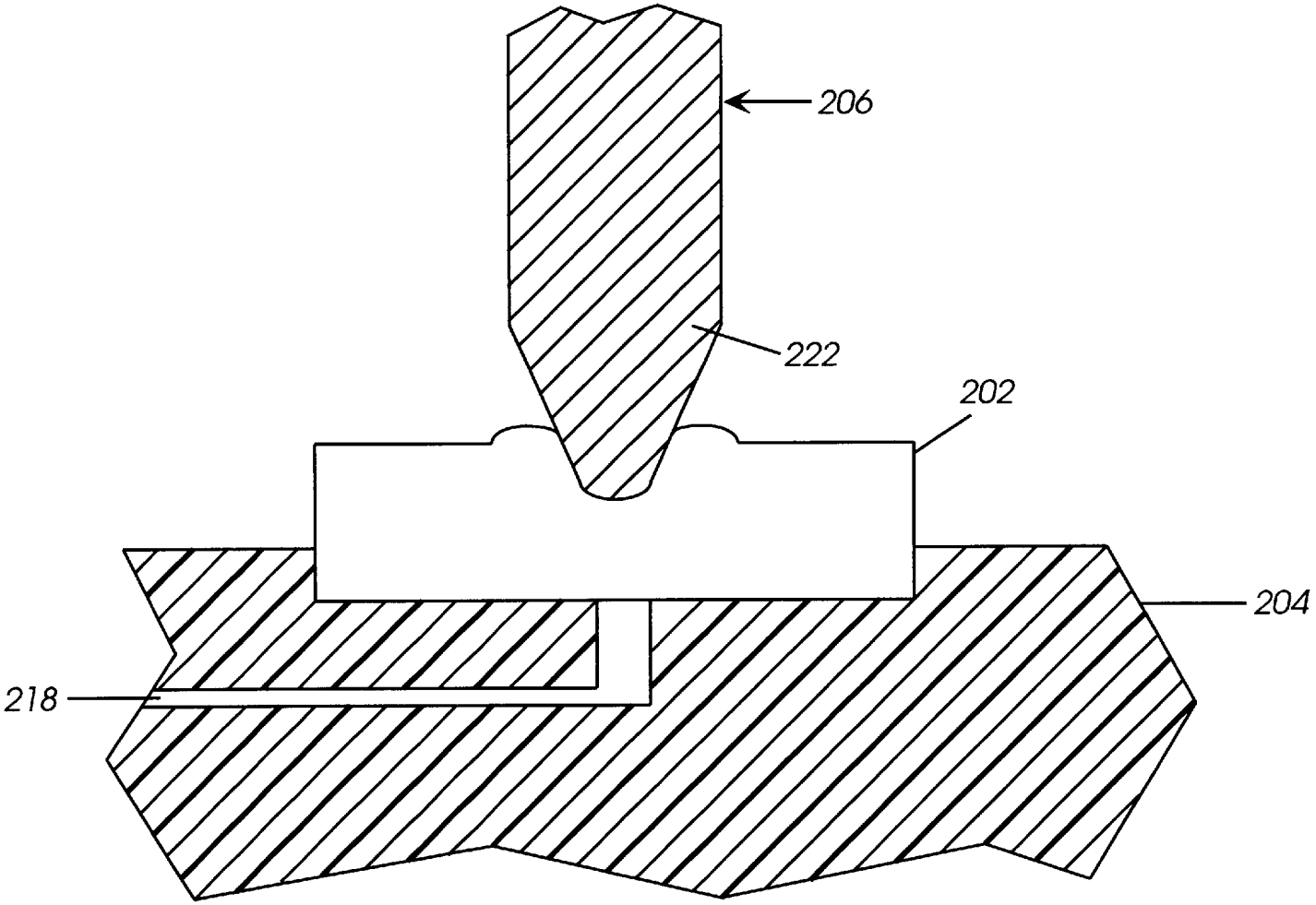
FIG. 8 is a side cross sectional view of a test probe inserted into a bond pad, as known in the art.
Figure 9:
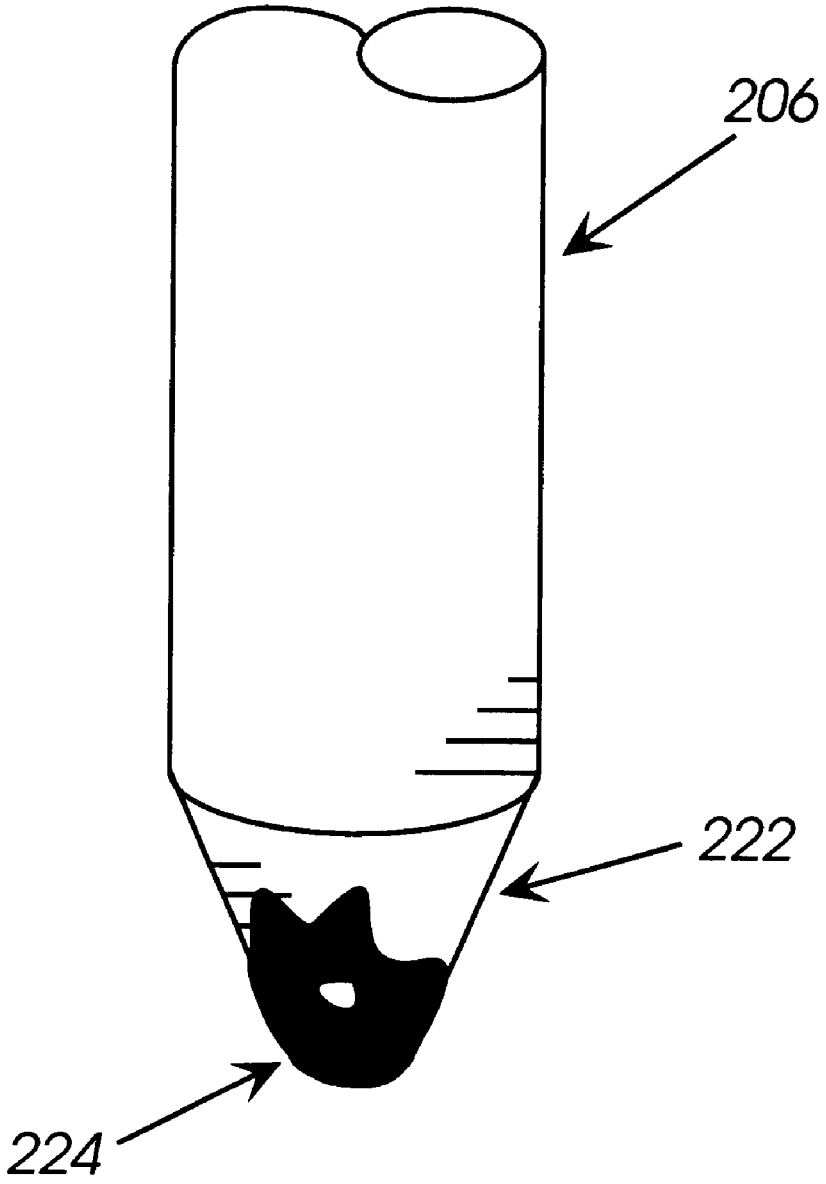
FIG. 9 is a side view of a test probe having debris thereon, as known in the art.

A typical IC wafer bond pad (see element 202 of FIG. 8) is a lead/tin alloy, usually in a weight percentage of 76% lead and 24% tin. Thus, the debris 124, which will be collected by a test probe 120, will primarily be this lead/tin alloy. For the removal of the lead/tin alloy, the test probe 120 is inserted through the first membrane 106 and into the oxidizing agent 104 of hydrogen peroxide at a concentration of 33% by volume and left in the oxidizing agent 104 for approximately 5 seconds, as illustrated in FIG. 1. A simplified example of the chemical reaction occurring with regard to largest constituent of the alloy, lead, is as follows:

$$H_2O_2+Pb \rightarrow PbO+H_2O$$

It is understood by those skilled in the art that this is the primary reaction of interest. As the hydrogen peroxide is the excess component, there will be, of course, some generation of $O_2$ and $PbO_2$ from the reaction.

It is, of course, understood that the oxidizing agent 104 must be of a sufficient depth to contact the substantially all of the debris 124 on the test probe tip 122 and that the test probe tip 122 must be inserted to a sufficient depth into the oxidizing agent 104 contact the substantially all of the debris 124.

The test probe 120 is then inserted through the second membrane 116 and into the cleaning agent 114 of glacial acid at a concentration of 100% by volume and left in the cleaning agent 114 for approximately 5 seconds, as illustrated in FIG. 1. A simplified example of the chemical reaction occurring with regard to largest constituent of the alloy, lead, is as follows:

$$PbO+2CH_3COOH \rightarrow 2(CH_3COO)^{-1}Pb^{+2}+H_2O$$

The lead salt (right hand side of the equation) will become dissolute in the cleaning agent 114, thus, removing the debris from the test probe tip 122. The second membrane 116 seals itself once the test probe is extracted, thus retaining the hazardous lead-acetate waste. The present invention enables an effective and practical on-line test probe cleaning which was not previously feasible throughout the industry.

It is, of course, understood that the cleaning agent 114 must be of a sufficient depth to contact the substantially all of the oxidized debris 126 on the test probe tip 122 and that the test probe tip 122 must be inserted into the cleaning agent 114 a sufficient depth to contact the substantially all of the oxidized debris 126.

Figure 2:
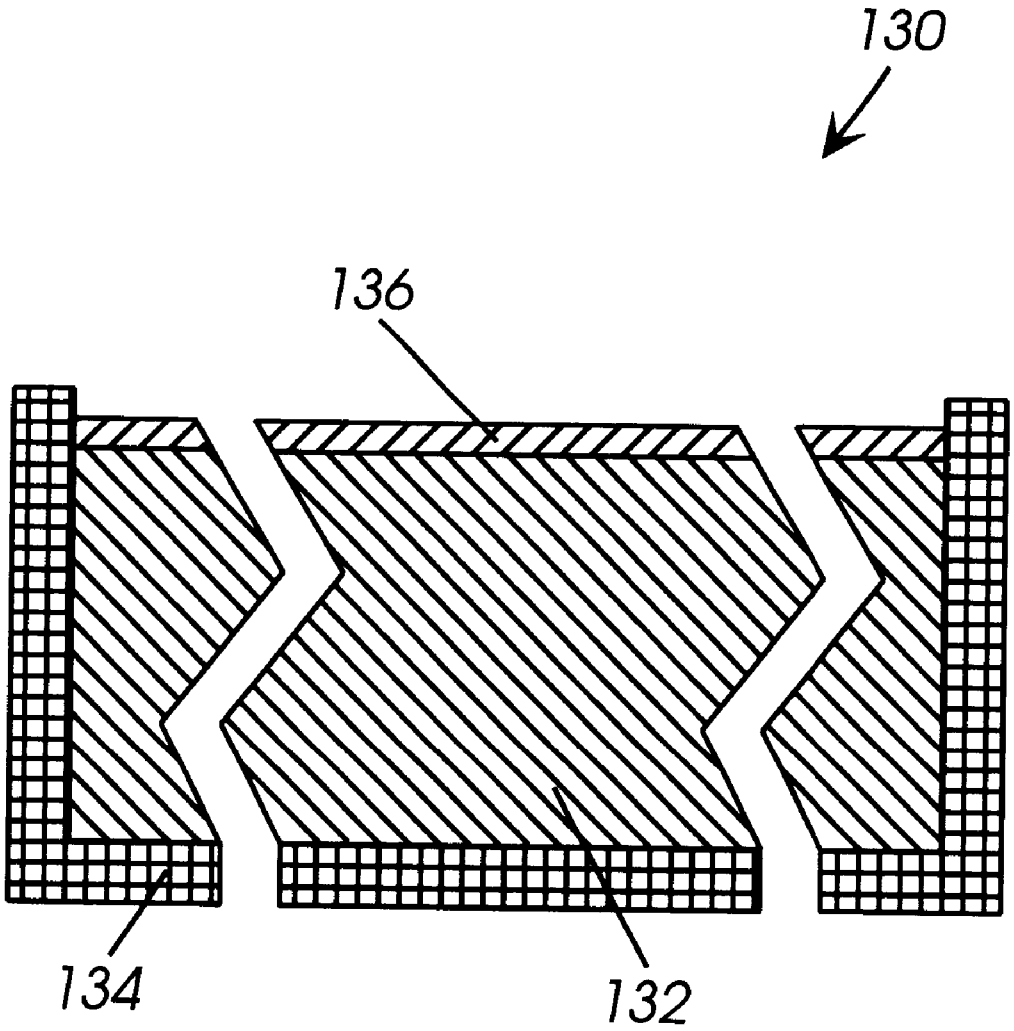
FIG. 2 is a side cross-sectional view of another embodiment of a test probe cleaning apparatus, according to the present invention.

FIG. 2 illustrates an alternate embodiment of a test probe cleaning apparatus 130, according to the present invention, wherein an oxidizing/cleaning agent 132 is contained in a single reservoir 134. Preferably, a membrane 136 is disposed over the oxidizing/cleaning agent 132. The oxidizing/cleaning agent 132 contains both an oxidizing component (i.e., the component which oxidizes debris on the probe tip 122—see FIG. 1) and a cleaning component (i.e., the component which dissolves the desbris after it oxidizes). Such an oxidizing/cleaning agent 132 may be utilized when the oxidizing component of the oxidizing/cleaning agent 132 is substantially non-reactive with the cleaning component of the oxidizing/cleaning agent 132.

Figure 3:
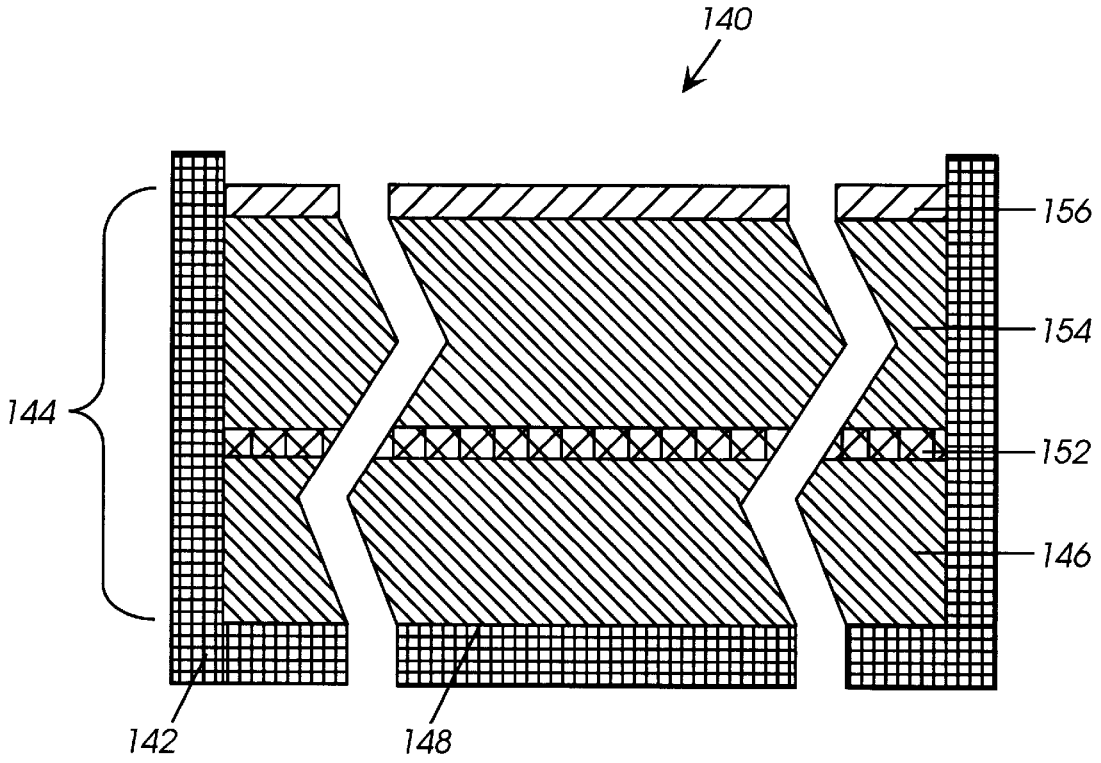
FIG. 3 is a side cross-sectional view of yet another embodiment of a test probe cleaning apparatus, according to the present invention.

FIG. 3 illustrates an embodiment of a test probe cleaning apparatus 140, according to the present invention. The test probe cleaning apparatus 140 comprises a reservoir 142 having a layered, cleaning material 144 disposed therein. The layered, cleaning material 144 comprises a cleaning agent 146, such as an acid solution, adjacent a bottom 148 of the reservoir 142. A first membrane 152 is disposed over the cleaning agent 146. An oxidizing agent 154, such as hydrogen peroxide, is disposed over the first membrane 152. The first membrane 152 is, preferably, a liquid that is substantially immiscible in both the cleaning agent 146 and the oxidizing agent 154. Thus, the first membrane 152 separates the cleaning agent 146 from oxidizing agent 154. However, it is understood that if the cleaning agent 146 is substantially immiscible and substantially non-reactive with the oxidizing agent 154, then the first layer 152 would not be required.

A second membrane 156 may be disposed over the oxidizing agent 154, wherein the second membrane 156 should be substantially immiscible in the oxidizing agent 154. The second membrane 156 prevents any off-gassing of the oxidizing agent 154, prevents reaction of the oxidizing agent 154 with ambient atmosphere, and/or helps prevent spills and expose to personnel. However, it is understood that if these issues are not a concern then the second membrane 156 is not necessary.

Figure 4A:
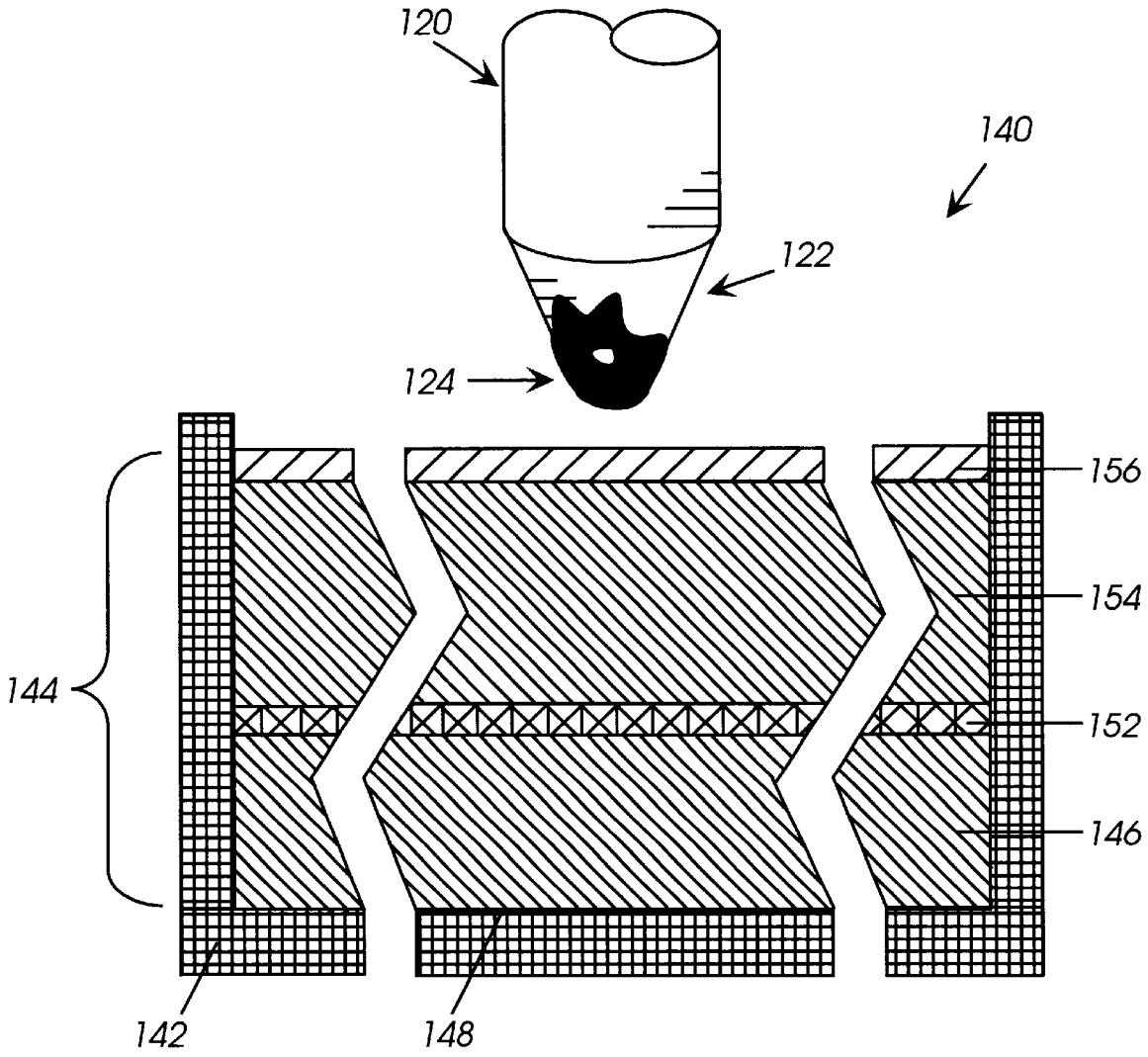
FIGS. 4*a*–4*c* are side cross-sectional views of a method of utilizing the embodiment of FIG. 3, according to the present invention.
Figure 4B:
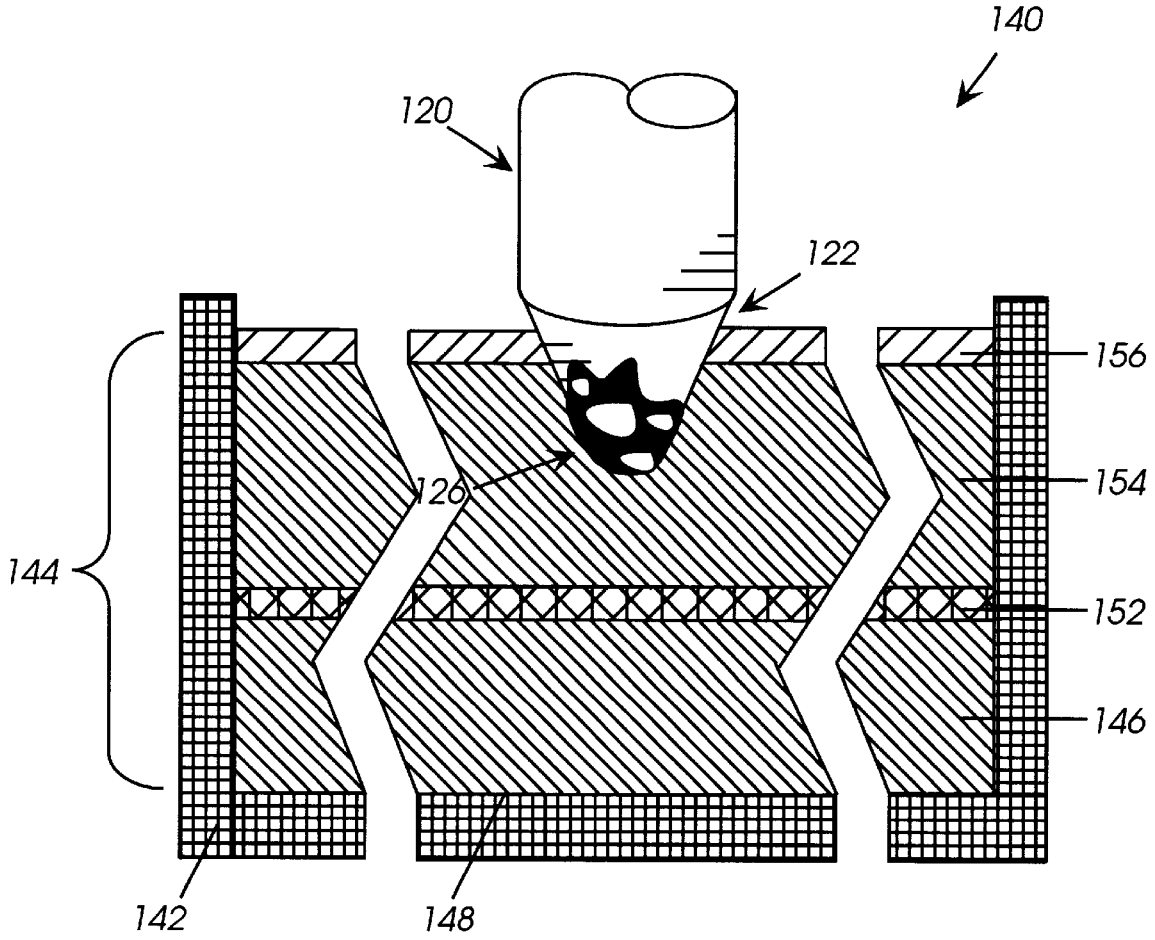
Figure 4C:
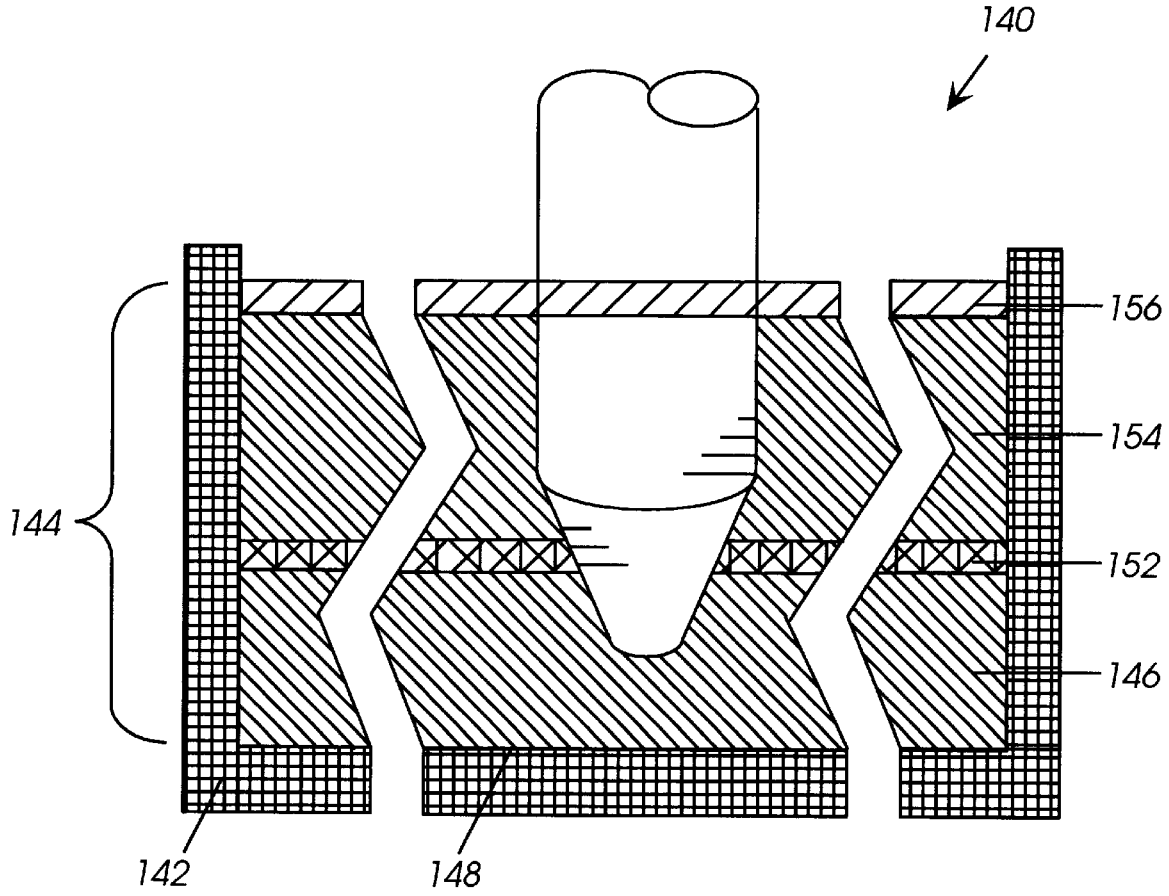

The test probe cleaning apparatus 140 of FIG. 3 is utilized in a manner shown in FIGS. 4*a*–4*c*. As shown in FIG. 4*a*, the test probe 120, having debris 124 on the test probe tip 122, is positioned over the layered, cleaning material 144. As shown in FIG. 4*b*, the test probe 120 is inserted through the second membrane 156 and into the oxidizing agent 154 ancl, preferably, held for a predetermined duration of time such that the debris 124 of FIG. 4*a* becomes oxidized into oxidized debris 126. As shown in FIG. 4*c*, the test probe 120 is further inserted through the first membrane 152 and into the cleaning agent 146 and held for a predetermined duration of time such that the oxidized debris 126 of FIG. 4*b* is dissolved from the test probe tip 122. After a predetermined duration of time, the test probe 120 is removed from the layered, cleaning material 144.

Figure 5:
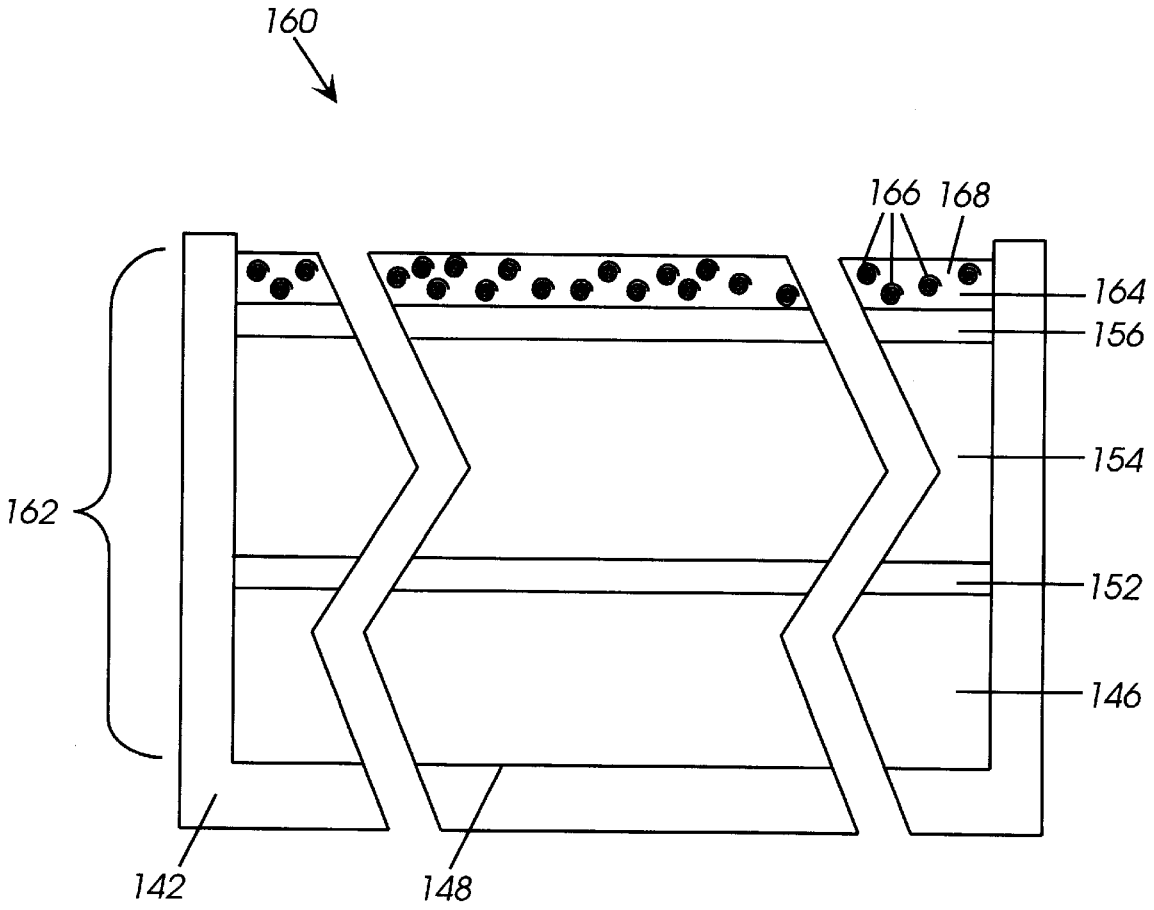
FIG. 5 is a side cross-sectional view of still another embodiment of a test probe cleaning apparatus having an abrasive layer, according to the present invention.

FIG. 5 illustrates another embodiment of a test probe cleaning apparatus 160 according to the present invention. The test probe cleaning apparatus 160 similar to the test probe cleaning apparatus 140 as illustrated in FIG. 5. However, the test probe cleaning apparatus 160 has a layered, cleaning material 162 which includes an abrasion material layer 164 disposed over the second membrane 156. The abrasion layer 164 preferably contains an abrasive material 166, such as synthetic diamond or aluminum oxide particle, and the like, suspended in a carrier material 168, such as cross-linked polymer (preferably benzocyclobutene, or other applicable copolymer). The second membrane 156 must be substantially immiscible in both the abrasion material layer 164 and the oxidizing agent 154. It is, of course, understood that if the abrasion material layer 164 is substantially immiscible in and non-reactive with the oxidizing agent 154 then the second membrane 156 is not require. Further, if the second membrane 156 is not used and if issues such as off-gassing of the oxidizing agent 154, reaction of the oxidizing agent 154 with ambient atmosphere, and/or spills and expose to personnel are problems, then the abrasion material layer 164 must be selected to address these issues.

Figure 6A:
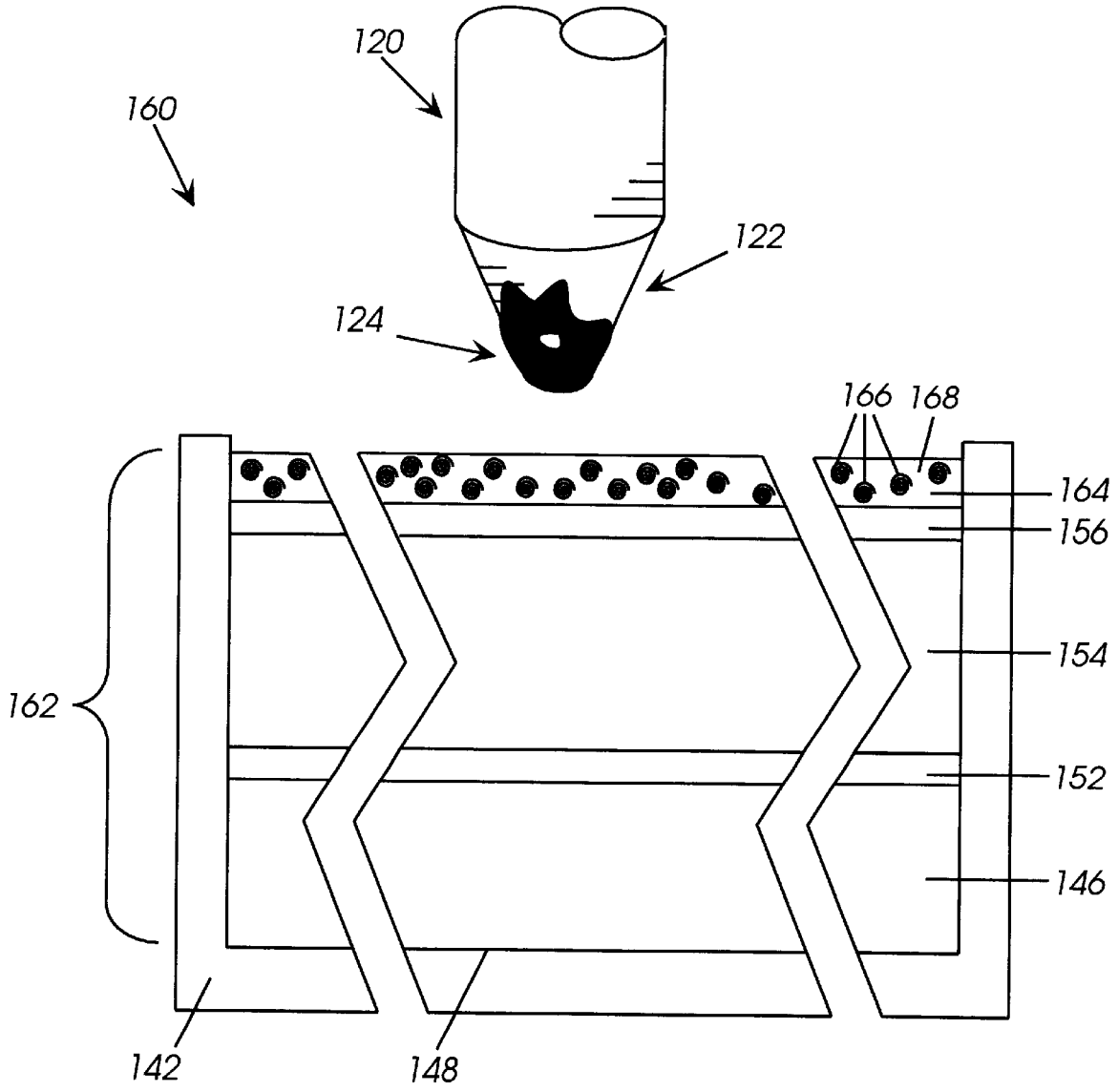
FIGS. 6*a*–6*c* are side cross-sectional views of a method of utilizing the embodiment of FIG. 5, according to the present invention.
Figure 6B:
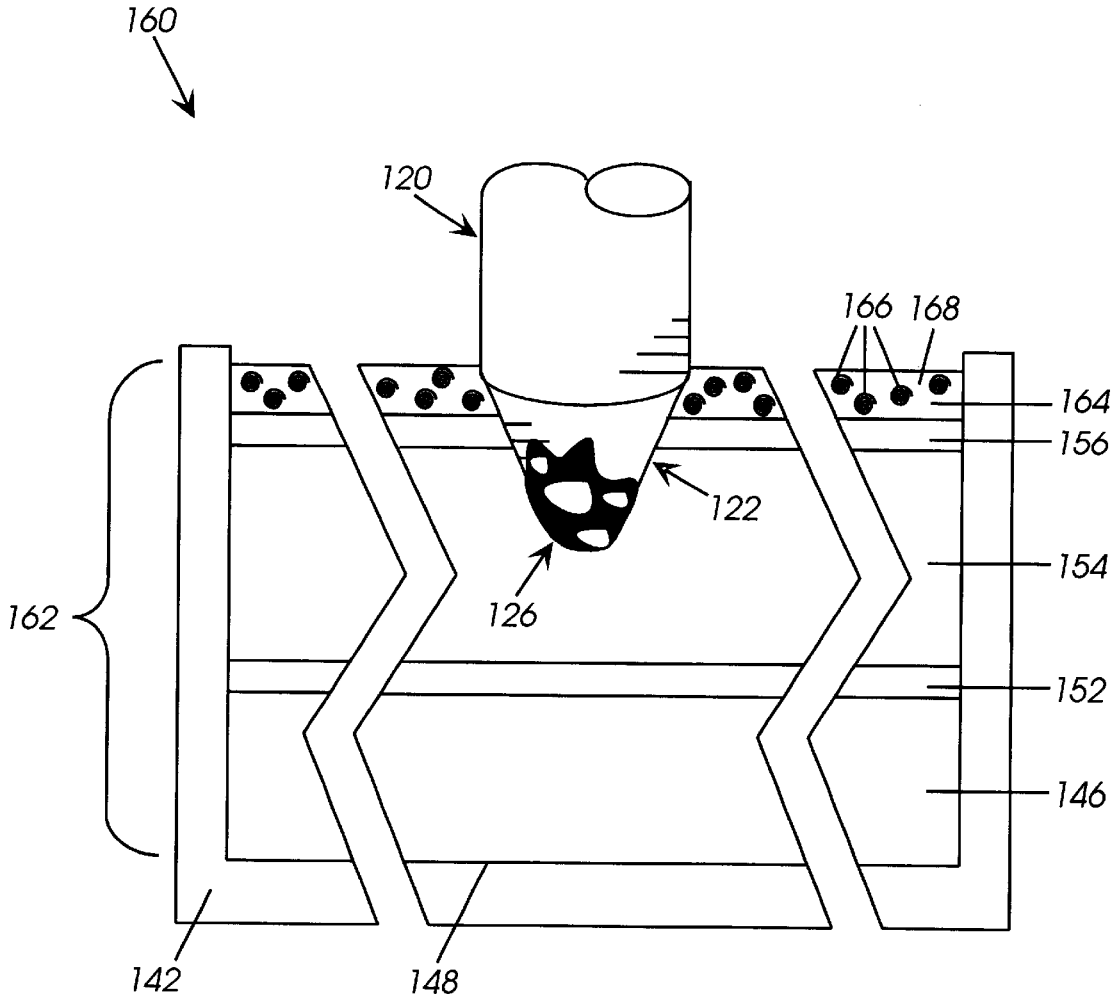
Figure 6C:
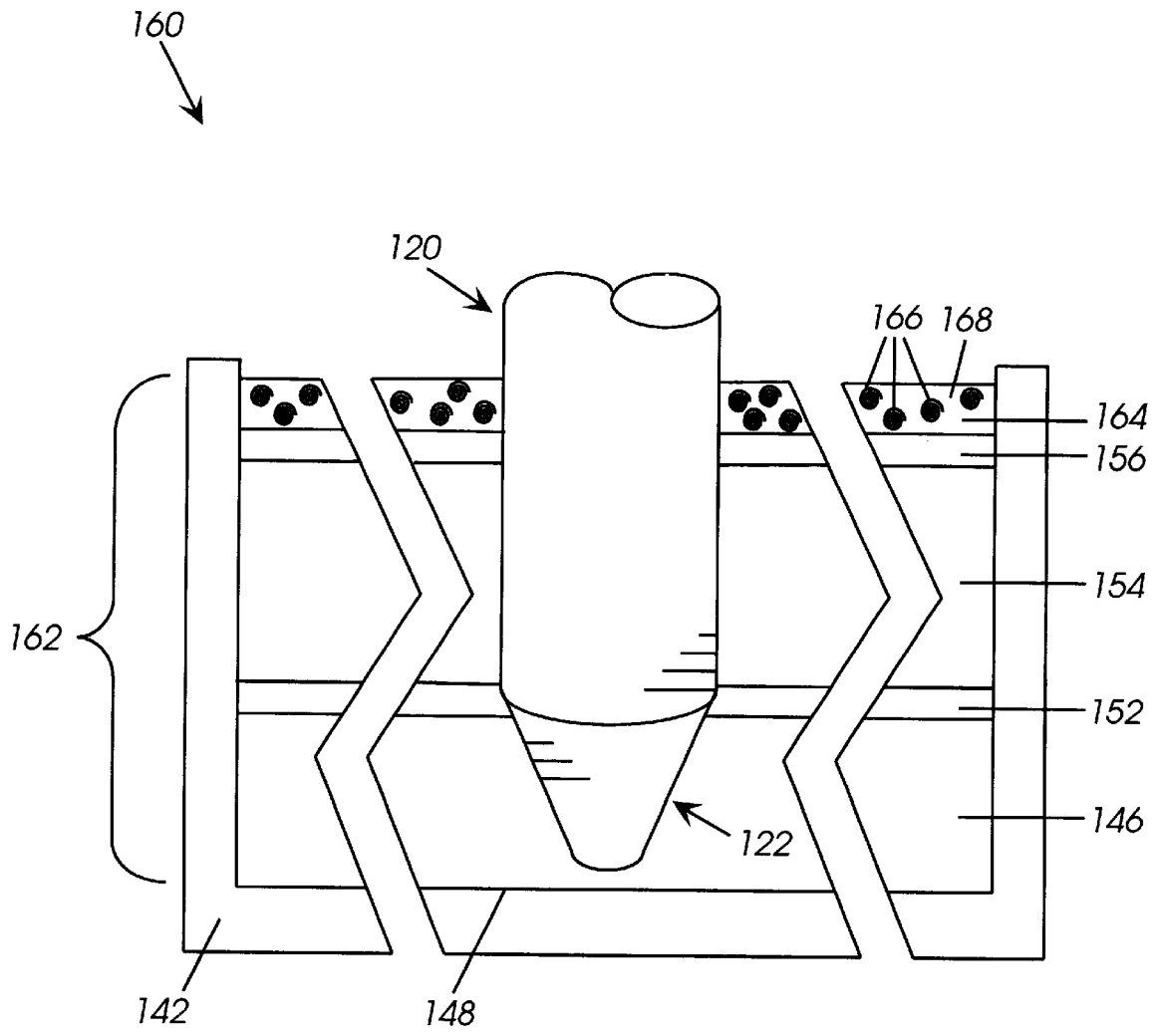
Figure 7:
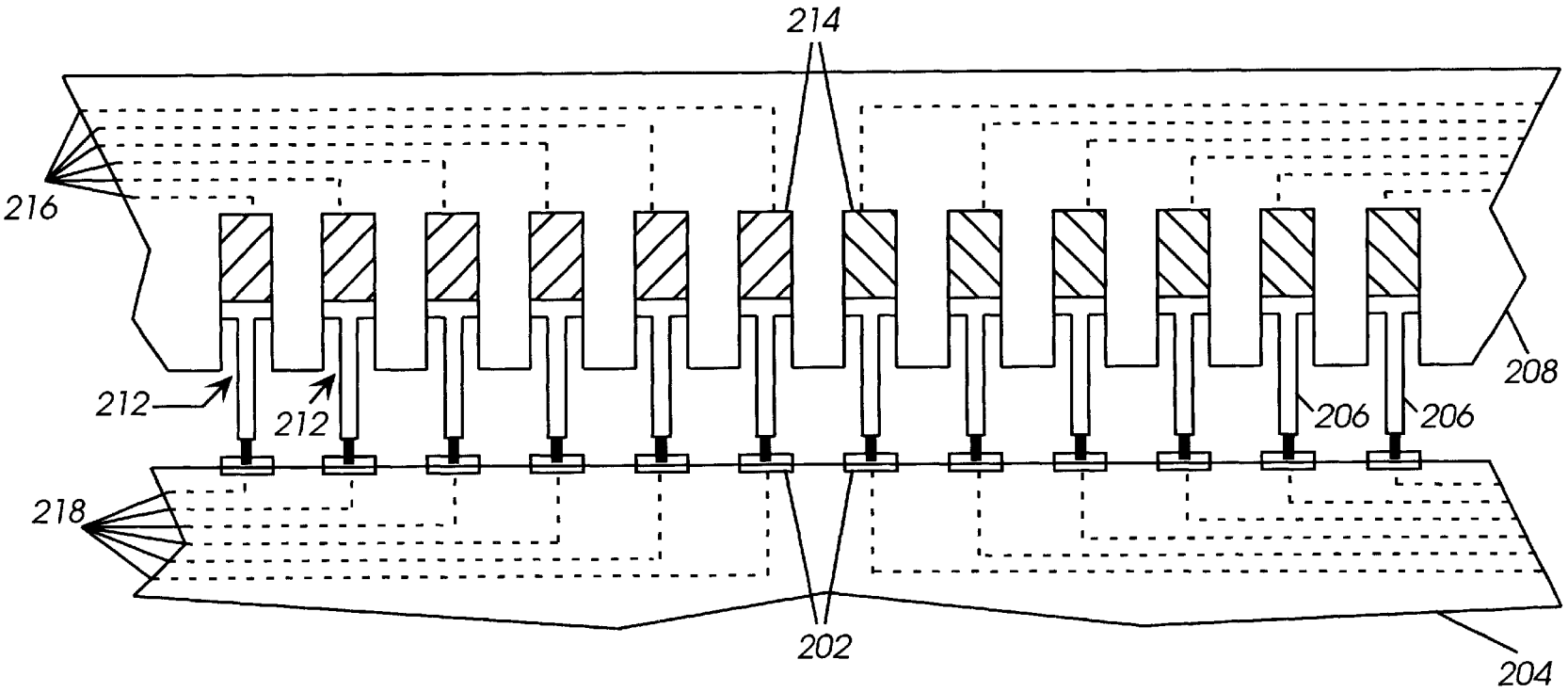
FIG. 7 is a side cross sectional view of a test probe array contacting bond pads on an IC wafer, as known in the art.

The test probe cleaning apparatus 160 of FIG. 5 is utilized in that manner shown in FIGS. 6*a*–6*c*. The test probe 120 is inserted through the abrasion material layer 164 which removes larger pieces of debris 124 from the test probe tip 122. The test probe 120 is then inserted through the second membrane 156 and into the oxidizing agent 154. After a predetermined duration of time, the test probe 120 further inserted through the first membrane 152 and into the cleaning agent 146 for removal of the oxidized debris 126. After a predetermined duration of time, the test probe 120 is removed from the layered, cleaning material 162.

It is, of course, understood that the abrasion material layer 164 can be incorporated into the test probe cleaning apparatus 100 of FIG. 1, wherein the abrasion layer 164 could reside over the oxidizing agent 104, with or without the first membrane 106. Alternately, the abrasion layer 164 could reside in its own reservoir.

Thus, the embodiments of this invention present a system that enables test probes to be cleaned in-situ or off-line without the need for special equipment or risk of chemical exposure. The invention enables an effective and practical on-line chemical cleaning system that was not previously feasible throughout the industry. Furthermore, the present invention should result in the extension of test probe lifetime and increase the mean-time between cleaning cycles.

Having thus described in detail embodiments of the present invention, it is understood that the invention defined by the appended claims is not to be limited by particular details set forth in the above description, as many apparent variations thereof are possible without departing from the spirit or scope thereof.

What is claimed is:

1. A method of cleaning a test probe, comprising:

providing at least one test probe having a debris thereon;

oxidizing said test probe debris in an oxidizing agent; and dissolving said oxidized debris in a cleaning agent.

2. The method of claim 1, wherein said dissolving said oxidized debris comprises dissolving said oxidized debris in glacial acid.

3. The method of claim 1, wherein said oxidizing said test probe debris comprises oxidizing said test probe debris in hydrogen peroxide.

4. The method of claim 1, wherein oxidizing said test probe debris comprises inserting said test probe through a first membrane layer and into said oxidizing agent.

5. The method of claim 4, wherein said inserting said test probe through said first membrane comprises inserting said test probe through a polymer and into said oxidizing agent.

6. The method of claim 1, wherein dissolving said oxidized debris comprises inserting said test probe through a second membrane layer and into said cleaning agent.

7. The method of claim 6, wherein said inserting said test probe through said second membrane comprises inserting said test probe through a polymer and into said oxidizing agent.

8. The method of claim 1, further including abrading said test probe debris prior to oxidizing said test probe debris.

9. The method of claim 1, further including abrading said test probe debris prior to oxidizing said test probe debris.

10. The method of claim 9, wherein said abrading said test probe debris comprises inserting said test probe into an abrasion material layer including an abrasive material suspended in a carrier material.

11. A method of cleaning a test probe, comprising:

providing at least one test probe having a debris thereon;

providing a layered, cleaning material comprising:

a cleaning agent; and an oxidizing agent disposed over said cleaning agent;

inserting said test probe into said oxidizing agent; and inserting said test probe into said cleaning agent.

12. The method of claim 11, wherein said inserting said test probe into said oxidizing agent comprises inserting said test probe into hydrogen peroxide.

13. The method of claim 11, wherein said inserting said test probe into said cleaning agent comprises inserting said test probe into glacial acid.

14. The method of claim 11, wherein inserting said test probe into said oxidizing agent further includes inserting said test probe through a first membrane layer and into said oxidizing agent.

15. The method of claim 14, wherein said inserting said test probe through said first membrane comprises inserting said test probe through a copolymer and into said oxidizing agent.

16. The method of claim 11, wherein inserting said test probe into said cleaning agent further includes inserting said test probe through a second membrane layer and into said cleaning agent.

17. The method of claim 16, wherein said inserting said test probe through said second membrane comprises inserting said test probe through a polymer and into said oxidizing agent.

18. The method of claim 11, further including abrading said test probe debris prior to oxidizing said test probe debris.

19. The method of claim 18, wherein said abrading said test probe debris comprises inserting said test probe into an abrasion solution.

20. The method of claim 19, wherein said abrading said test probe debris comprises inserting said test probe into an abrasion solution including an abrasive material suspended in a carrier material.

21. A layered, test probe cleaning material, comprising:

a reservoir;

a cleaning agent disposed within said reservoir; and an oxidizing agent disposed over said cleaning agent within said reservoir.

22. The layered, test probe cleaning material of claim 21, wherein said cleaning agent comprises glacial acid.

23. The layered, test probe cleaning material of claim 21, wherein said oxidizing agent comprises hydrogen peroxide.

24. The layered, test probe cleaning material of claim 21, further comprising a first membrane disposed between said cleaning agent and said oxidizing agent.

25. The layered, test probe cleaning material of claim 24, wherein said first membrane comprises a polymer.

26. The layered, test probe cleaning material of claim 21, further comprising a second membrane disposed over said oxidizing agent within said reservoir.

27. The layered, test probe cleaning material of claim 26, wherein said first membrane comprises a polymer.

28. The layered, test probe cleaning material of claim 21, further comprising an abrasion layer disposed over said oxidizing agent within said reservoir.

29. The layered, test probe cleaning material of claim 28, wherein said abrasion layer comprises an abrasive material suspended in a carrier material.

30. The layered, test probe cleaning material of claim 29, wherein said abrasive material is selected from the group consisting of synthetic diamond and aluminum oxide.

* * * * *

UNITED STATES PATENT AND TRADEMARK OFFICE

CERTIFICATE OF CORRECTION

PATENT NO. : 6,280,298 B1
DATED : August 28, 2001
INVENTOR(S) : Gonzales

It is certified that error appears in the above-identified patent and that said Letters Patent is hereby corrected as shown below:

Column 3,
Line 43, delete "linkeable", insert -- linkable --.

Column 5,
Line 26, delete "ancl", insert -- and --.

Signed and Sealed this

Fourth Day of June, 2002

*Attest:*

*Attesting Officer*

JAMES E. ROGAN
*Director of the United States Patent and Trademark Office*